US005160599A

United States Patent [19]

Kobayashi et al.

[11] Patent Number: 5,160,599

[45] Date of Patent: Nov. 3, 1992

[54] PROCESS FOR COLORING TITANIUM AND ITS ALLOYS

[75] Inventors: Kenzo Kobayashi, 1-33-3, Inukura, Miyamae-ku, Kawasaki-shi, Kanagawa; Kenichi Shimizu, 4-6-12, Kyouwa, Sagamihara-shi, Kanagawa; Hideaki Yoshioka, Sendai, all of Japan

[73] Assignees: Kenzo Kobayashi, Kawashi; Kenichi Shimizu, Sagamihara; Yoshida Kogyo K.K., Tokyo, all of Japan

[21] Appl. No.: 540,150

[22] Filed: Jun. 19, 1990

[30] Foreign Application Priority Data

Jul. 7, 1989 [JP] Japan ..... 1-174286

[51] Int. Cl.[5] ..... C25D 11/34

[52] U.S. Cl. ..... 205/106; 205/171; 205/322

[58] Field of Search ..... 204/42, 43.1; 205/106, 205/171, 322

[56] References Cited

U.S. PATENT DOCUMENTS 2,711,496 6/1955 Ruben ..... 204/42
3,398,067 8/1968 Raffalovich ..... 204/42
3,466,230 9/1969 Carthers ..... 204/42
3,989,876 11/1976 Moji et al. ..... 204/42
4,131,520 12/1978 Bernard et al. ..... 204/42

FOREIGN PATENT DOCUMENTS 58-71393 4/1983 Japan .
1-123097 5/1989 Japan .

*Primary Examiner*—John Niebling
*Attorney, Agent, or Firm*—Flynn, Thiel, Boutell & Tanis

[57] ABSTRACT

The present invention provides a process for coloring titanium, or its alloys which comprises the steps of anodizing titanium metal, or its alloy in an electrolytic solution until the voltage reaches a predetermined voltage at a constant current temporarily cutting off the current supply to interrupt the anodizing; and then supplying a direct current again at a predetermined current density to continue anodizing, wherein the color tone of the anodic oxide film formed on the titanium or its alloy is adjusted by controlling the supplied amount of current, without causing an increase in voltage. By the coloring process of the present invention, the color of titanium metal or its alloys can be changed to various color tones at low voltages.

10 Claims, 2 Drawing Sheets

PROCESS FOR COLORING TITANIUM AND ITS ALLOYS

BACKGROUND OF THE INVENTION

1. Field of the Invention

The present invention relates to the coloration of titanium and its alloys, which have been increasingly used as decorative and corrosion-resistant materials in recent years. In particular, this invention relates to a novel process for coloring titanium and its alloys in which the coloring is adjusted by controlling the supplied amount of current. The process is quite different from conventional coloring processes by anodic oxidation in which the coloring has been adjusted by means of voltage control.

2. Description of the Prior Art

Titanium has found growing applications, especially in structural materials of aerospace crafts or nuclear power plants or other chemical industrial materials, because of its advantages of lightness of weight, high specific strength and superior high corrosion-resistance. Further, in recent years, titanium has found new applications in building materials, for example, for roofs and curtain walls and other interior structural members. Particularly, in building materials, it is necessary to provide colors onto the surfaces of such building materials by anodic oxidation, etc., with a view to providing high levels of artistic effects. Many studies have been made on such coloring films.

The coloration of titanium has been heretofore achieved by employing interference colors which result from thin oxide films formed onto the surface of titanium metal by means of anodic oxidation using titanium as an anode in certain electrolytic solutions. The resulting interference color is changed to various color tones depending upon the thickness of the formed anodic oxide film. Further, since there is a direct correlation between the anodic oxide film and the applied voltage, delicate color control can be effected by controlling the applied voltage. Currently, practical processes utilize the foregoing characteristic aspects.

Among the above studies, the most practical anodic oxidation is carried out by applying a direct voltage to an electrolytic solution containing, for example, phosphoric acid, sulfuric acid or boric acid, using titanium as an anode and thereby forming an oxide film onto the surface of the titanium and growing the oxide film. In such a process, the thickness of the resultant oxide film is variable depending upon the applied voltage and the light interference also differs depending on the thickness of the oxide film. Consequently, various color tones are produced. For instance, when an electrolytic solution of phosphoric acid is employed, the anodic oxide film is colored in blue tones by applying a voltage of 25 volts and, with increasing the applied voltage, the anodic oxide film becomes thicker and the interference color by the surface film changes to various colors, for example, to yellow, to pink, to purple and to green. When a voltage of 120 volts is applied, the color turns into a reddish violet color. Therefore, color adjustment has been effected by voltage control and, when various color tones are desired, it is essential to use an electric power unit having a high withstand voltage. Generally, an electric power unit having a withstand voltage of the order of at least 150 volts is needed.

As set forth above about the prior art processes, an electric power unit with a high withstand voltage must be employed in order to form a variety of color tones on titanium. On the other hand, presently industrialized anodic oxidation processes, for example, an aluminum anodic oxidation process, employ an electric power source unit having a low withstand voltage ranging from 20 to 30 volts for the formation and growth of an anodic oxide film. Therefore, if the coloration of titanium becomes possible employing such an electric power unit with a low withstand voltage, the above electric power unit currently used would be also used for the coloration of titanium and a further expanded application could be expected.

SUMMARY OF THE INVENTION

It is therefore an object of the present invention to provide a process for coloring titanium and its alloys which makes possible the adjustment of coloration at low voltages.

In order to achieve this object, the present invention provides a process for coloring titanium or its alloys which comprises the steps of anodizing titanium metal or its alloys in an electrolytic solution until the voltage reaches a predetermined voltage at a constant current density; temporarily cutting off the current supply to interrupt the anodizing; and then supplying again a direct current at a predetermined current density to continue the anodizing, wherein the color tone of the anodic oxide film formed on the titanium or its alloys is adjusted by controlling the supplied amount of current, without causing an increase in voltage.

DETAILED DESCRIPTION OF THE PREFERRED EMBODIMENTS

Figure 1:
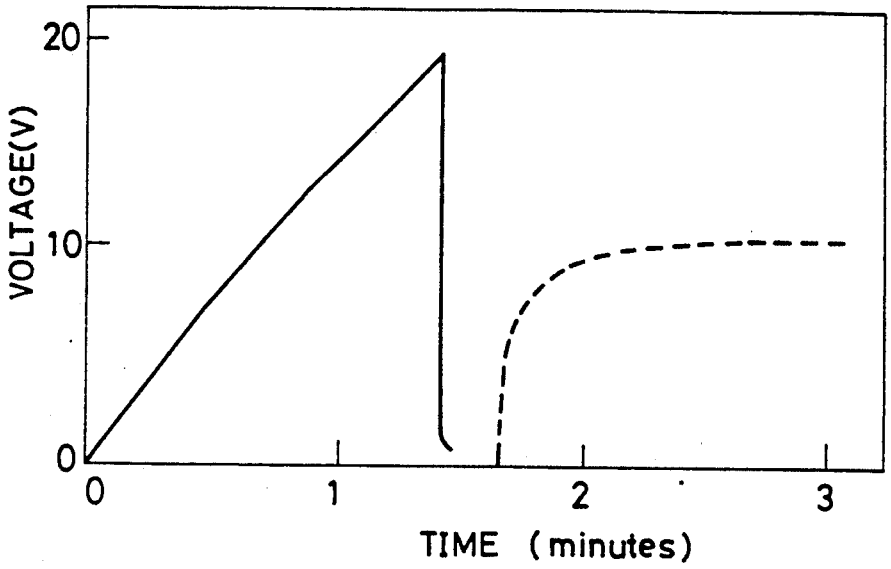
FIG. 1 is a volt-time curve of Example 1.

The present Inventors have extensively made many studies on the mechanism of the anodic oxidation of titanium and the structure of the resultant anode oxide films and found that, when using an aqueous electrolytic solution of phosphoric acid, coloration of the surface of titanium can be adjusted by changing the supplied amounts of current at a voltage of about 10 volts, without increasing the voltage. The present invention have been arrived on the basis of such a finding. More specifically, anodic oxidation is first conducted at a constant current density using a direct current electric source until the voltage reaches 20 volts, at which evolution of oxygen begins, and, at this point, the current supply is temporarily cut off to interrupt anodic oxidation. (Hereinafter, the voltage when anodic oxidation is interrupted is referred to as "temporary interruption voltage".) Thereafter, when a constant current is supplied again to continue anodic oxidation, the voltage becomes almost constant in the vicinity of 10 volts without returning to the temporary interruption voltage of 20 volts before the interruption of anodic oxidation. Nevertheless, when the supplied amount of current is increased by continuing the current supply, the surface of titanium is changed into various color tones.

Further experimentation has showed that when the temporary interruption voltage is 15 volts, the voltage is increased by supplying current again and stabilization of voltage as set forth above has not been confirmed.

However, also in such a case, if a constant current is supplied again until the voltage reaches 20 volts and the current supply is interrupted again at that voltage and, thereafter, current is supplied again, the voltage recovers up to about 10 volts and stabilizes. When the current supply is further continued, the colored surface is, as previously mentioned, changed to various color tones depending on the supplied amount of current. In the above anodic oxidation process using aqueous phosphoric acid solution, oxygen evolution is observed on the surface of titanium in the vicinity of about 20 volts. However, when the temporary interruption voltage is 15 volts, such oxygen evolution can not be observed and the voltage is continuously increased by continuing the current supply. Therefore, it is essential that the temporary interruption voltage be at least the voltage of oxygen evolution in the used aqueous electrolytic solution.

The above-mentioned phenomenon is not limited only to an aqueous phosphoric acid solution. A similar phenomenon can be also observed in other electrolytic solutions, i.e., aqueous boric acid solution and aqueous sulfuric acid solution can be similarly stated. For example, the temporary interruption voltage of an aqueous boric acid solution is about 15 volts. When anodic oxidation is continued in the solution by supplying a constant current after the interruption of anodic oxidation at about 15 volts, the voltage becomes constant at about 10 volts without returning to the voltage of 15 volts before the interruption. At this anodic oxidation, when current is continuously supplied and the cumulative amount of current is increased, the surface of titanium is changed to various colors, as referred to in the case of the above-mentioned phosphoric acid solution. Also, in this case, when the temporary interruption voltage is lower than 15 volts, the voltage is increased by supplying the current again and no voltage-stabilizing phenomenon is confirmed. Further, oxygen evolution is not observed. From such results, it is necessary that the temporary interruption voltage be at least the voltage at which oxygen evolution occurs.

The temporary interruption voltage of a sulfuric acid solution is on the order of about 10 volts and is lower than those of aqueous phosphoric acid solution and aqueous boric acid solution. However, as stated for phosphoric acid and boric acid, the color tones are also changed only by supplying current, without increasing the voltage.

Coloration by the anodic oxidation process as set forth above is not limited to pure titanium. Such a coloring process is also applicable to titanium-based alloys which have been subjected to anodic oxidation and alloys of Ti-6Al-4V, Ti-8Al-1Mo-1V or the like, which are most frequently employed as high strength materials, are exemplified. More specifically, so long as alloys contain titanium as a principal element and other additive elements are dissolved in a solid solution state in titanium, color adjustment can be achieved without any undesirable effect. Further, the coloring process of the present invention is also effectively applicable to alloys with metal (e.g., Al, Zr, etc.) which can be anodized similarly to titanium and, also in such alloys, titanium should be contained as a principal alloying element.

As described in detail above, in the coloring process of the present invention, an anodic oxide film is grown by supplying a constant current until the voltage reaches the voltage of oxygen evolution, and then the electrical power supply is temporarily discontinued and supplied again. In such a manner, various color tones are created only by changing the supplied amount of current, without increasing the voltage.

In the process, the constant current to be applied is properly determined depending, for example, on the kind and concentration of the electrolytic solution. The applied current density of the first anodizing step and the applied current density of the later anodizing step are not always required to be the same. They may be varied as necessary.

Now, the advantages and effects of the present invention will be described. Generally, the most useful material in the field of decoration for building materials is aluminum and aluminum is usually surface-treated by means of anodic oxidation. Since the requisite voltage for the anodic oxidation of aluminum ranges from 10 to 20 volts, an electric source unit with a withstand voltage of 20 to 30 volts has been used. Therefore, when such a unit is used in conventional anodic oxidation processes of titanium, color tones of anodic oxide films can not be changed in a wide range. However, the present invention makes, for example, the anodizing installation for aluminum also useful for the anodic oxidation of titanium and its alloys by only changing the electrolytic solution. Also, when a new electric power supply unit is installed, the process of the present invention has, for example, the advantage that the withstand voltage of the unit can be designed at low levels and is extremely effective.

Hereinafter, the present invention will be described more specifically with reference to the following examples.

EXAMPLE 1

A titanium foil (thickness: 100 μm, purity: 99.8%) degreased with acetone was subjected to chemical polishing in a solution consisting of 75% by volume $HNO_3$ and 25% by volume HF, fully rinsed with distilled water and dried in hot air. The thus treated sample was anodically oxidized in an aqueous solution of 0.4M phosphoric acid at 25° C. at a constant current density of 10 $A/m^2$ and, when the voltage reached 20 volts at which gas evolution began, the current supply was temporarily discontinued to interrupt the anodic oxidation. Then, anodic oxidation was continued again at a current density of 10 $A/m^2$. FIG. 1 shows the voltage change versus time during the above process. Current was supplied again after the interruption of the anodic oxidation but the voltage did not return to the voltage of 20 volts before the interruption of the anodic oxidation. The voltage became almost constant in the vicinity of 10 volts, as shown by the dotted line, and gas evolution was observed on the surface of the sample. Further, it was confirmed from a further detailed observation of the surface of the sample that the color of the sample changed from the brown color of the anodic oxide film formed during the first anodic oxidation up to 20 volts to reddish brown after a lapse of 30 seconds, to reddish purple after a lapse of 60 seconds and to blue after a lapse of five minutes, with increases in the supplied amount of current, notwithstanding the voltage remaining almost constant at a voltage of 10 volts throughout the later anodic oxidation. As can be seen from such results, color tones could be adjusted by controlling the supplied amount of current, without increasing the voltage.

EXAMPLE 2

The same titanium foil as set forth in Example 1 was chemically polished in the same way as described in Example 1. In the same electrolytic solution as set forth in Example 1, anodic oxidation was carried out at a constant current density of 10 $A/m^2$ and interrupted by temporarily breaking the current supply when the voltage reached 15 volts. Thereafter, current was supplied again at a current density of 10 $A/m^2$ to continue the anodic oxidation.

Figure 2:
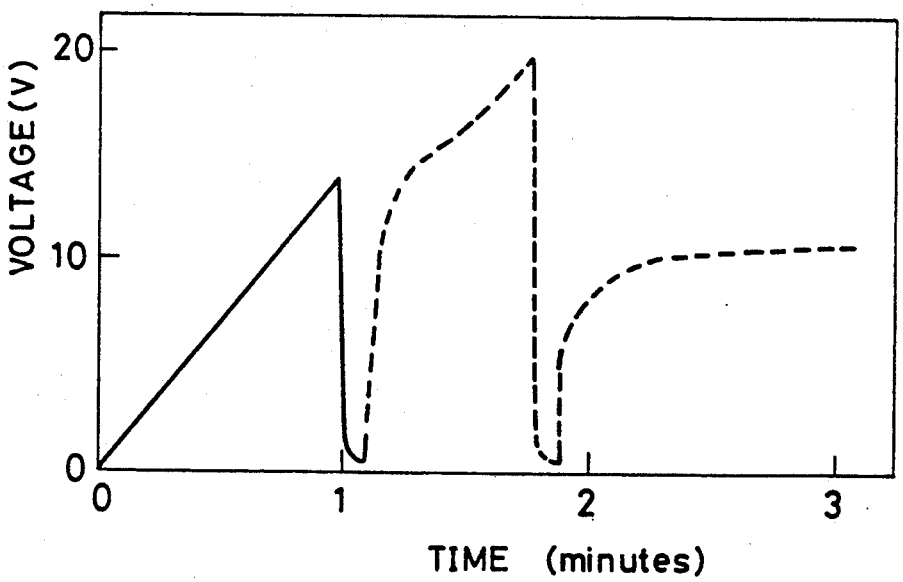
FIG. 2 is a volt-time curve of Example 2.

FIG. 2 shows the voltage change with time during the above anodic oxidation procedures. It can be seen from FIG. 2 that when the current supply is temporarily discontinued at 15 volts, the voltage is increased by supplying current again.

However, when the current supply was discontinued again at the voltage of 20 volts, the voltage did not return to the voltage of 20 volts by supplying the current again. The voltage was almost constant in the vicinity of 10 volts, as shown in the dotted line, and gas evolution was observed on the surface of the sample. Also, in this process, it was confirmed that the color tone of the sample changed from the brown color of the anodic oxide film formed during the first anodic oxidation up to 20 volts to reddish brown after a lapse of 30 seconds, to reddish purple after a lapse of 60 seconds and to blue after a lapse of five minutes, with increases in the supplied amount of current, notwithstanding the voltage remaining almost constant at 10 volts. As will be apparent from such results, color control could be effected by adjusting the supplied amount of current without increasing the voltage.

EXAMPLE 3

Figure 3:
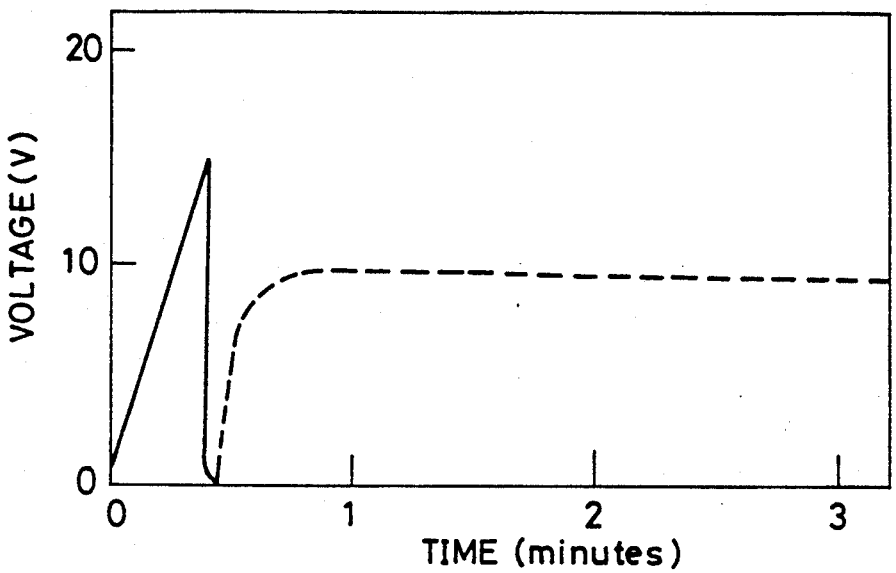
FIG. 3 is a volt-time curve of Example 3.

A titanium foil (thickness: 100 μm, purity: 99.8%) degreased with acetone was chemically polished in a solution consisting of 75% by volume $HNO_3$ and 25% by volume HF, fully rinsed with distilled water and dried in hot air. The thus surface-treated sample was anodically oxidized in an aqueous solution of 0.1M $(NH_4)_2O.5B_2O_3$ (ammonium borate) at 25° C. at a constant current density of 5 $mA/cm^2$ and, when the voltage reached 15 volts, at which gas evolution began, the current supply was temporarily discontinued to interrupt the anodic oxidation. Then, anodic oxidation was continued by supplying the current again at a current density of 5 $mA/cm^2$. FIG. 3 shows the voltage change versus time. The voltage did not return to 15 volts before the interruption of the anodic oxidation, notwithstanding the current was supplied again after the interruption of the anodic oxidation. As shown by the dotted line, the voltage became almost constant in the vicinity of 10 volts and gas evolution was observed on the surface of the sample. It was confirmed from a further detailed observation of the surface of the sample that the color tone of the sample changed from the orange color of the anodic oxide film formed during the anodic oxidation up to 15 volts to brown after a lapse of 30 seconds, to purple after a lapse of 60 seconds and blue after a lapse of 4 minutes with increases in the supplied amount of current, notwithstanding the voltage remaining almost constant at 10 volts throughout the later anodic oxidation. As can be seen from such results, color control was possible by adjusting the supplied amount of current, without increasing the voltage.

EXAMPLE 4

Figure 4:
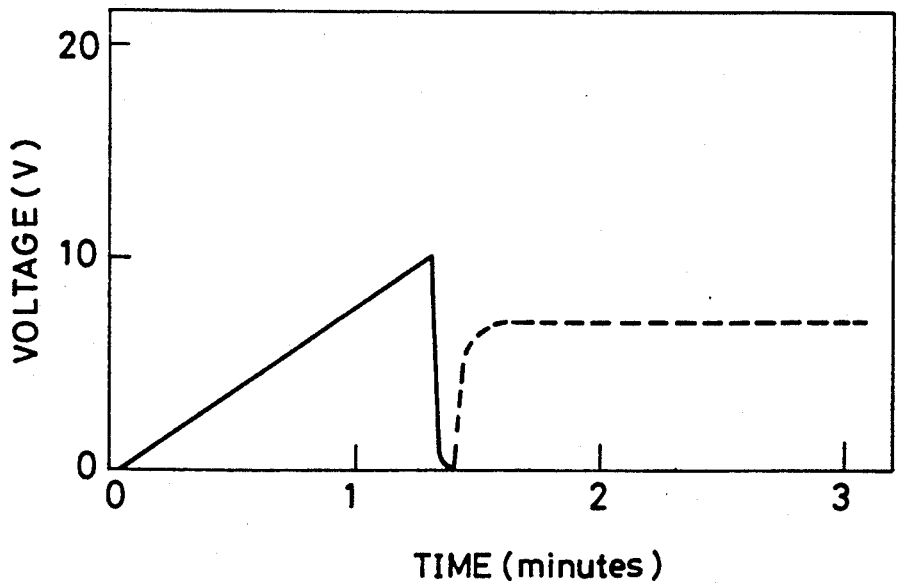
FIG. 4 is a volt-time curve of Example 4.

A titanium foil (thickness: 100 μm, purity: 99.8%) degreased with acetone was chemically polished in a solution consisting of 75% by volume $HNO_3$ and 25% by volume HF, fully rinsed with distilled water and dried in hot air. The thus surface-treated sample was anodically oxidized in a 20% by volume aqueous solution of $H_2SO_4$ at 25° C. at a constant current voltage of 10 volts, which is higher than the voltage of gas evolution, the current supply was temporarily discontinued to interrupt the anodic oxidation. Then, the anodic oxidation was continued by supplying current again at a current density of 10 $mA/cm^2$. FIG. 4 shows the voltage change versus the lapse of time. The current was supplied again after the interruption of the anodic oxidation but the voltage did not return to the voltage of 10 volts before the interruption of the anodic oxidation. As shown by the dotted line, the voltage became almost constant in the vicinity of 7 volts and gas evolution was observed on the surface of the sample. It was confirmed from a further detailed observation of the surface of the sample that the color tone of the sample changed from the yellowish orange of the anodic oxide film formed during the anodic oxidation up to 10 volts to reddish brown after a lapse of 60 seconds, to reddish purple after a lapse of 2 minutes and blue after a lapse of 10 minutes with increases in the supplied amount of current, notwithstanding the voltage remaining almost constant at 7 volts throughout the later anodic oxidation. As can be seen from such results, color control was possible by adjusting the supplied amount of current, without increasing the voltage.

EXAMPLE 5

Various kinds of titanium alloys were fully degreased with acetone and then anodically oxidized in each of three different kinds of electrolytic solutions. The temporary interruption voltage (volt) of each case was measured and given in the Table below.

| | Solution (25° C.) | | |
|---|---|---|---|
| Alloy | $0.4MH_3PO_4$ | $0.1M(NH_4)_2O.5B_2O_3$ | 20 vol % $H_2SO_4$ |
| Ti—6Al—4V | 22 | 17 | 10 |
| Ti—6Al—1Mo—1V | 22 | 17 | 10 |
| Ti—12Al | 20 | 15 | 7 |
| Ti—10Zr | 20 | 15 | 7 |
| Ti—8Ta | 25 | 20 | 12 |
| Ti—15Nb | 23 | 18 | 10 |
| Ti—10Al—5Zr | 20 | 15 | 7 |
| Ti—5Ta—6Nb | 25 | 20 | 12 |
| Ti—7Zr—8Nb | 23 | 18 | 10 |

As described above, the present invention provides a process for anodically oxidizing titanium or its alloys in which the surface color of titanium metal or its alloys can be changed over a wide range, employing an electric source unit with a low withstand voltage, as used in the anodic oxidation of aluminum.

What is claimed is:

1. A process for coloring a metal selected from the group consisting of titanium and a titanium-containing alloy, comprising the steps of:

in a first anodizing step, anodizing said metal in an aqueous electrolytic solution at a constant current density and thereby progressively increasing the first anodizing voltage to a first level which is at least as high as the level at which oxygen evolution begins in the aqueous electrolytic solution;

then interrupting the supply of current and discontinuing said first anodizing step;

then in a second anodizing step, further anodizing said metal in an aqueous electrolytic solution at a constant current density and thereby progressively increasing the second anodizing voltage to a constant second anodizing voltage which is lower then said first level of said first anodizing voltage, and continuing the second anodizing step while maintaining the second anodizing voltage constant for a period of time effective to form an oxide film of the desired color on said metal.

2. The process of claim 1, wherein said first level is the voltage at which oxygen evolution occurs in said aqueous electrolytic solution.

3. The process of claim 1, wherein the aqueous electrolytic solution contains phosphoric acid.

4. The process of claim 3, wherein second anodizing voltage is about 10 volts.

5. The process of claim 3, wherein said first level is about 20 volts.

6. The process of claim 1, wherein the aqueous electrolytic solution contains boric acid.

7. The process of claim 6, wherein said second anodizing voltage is about 10 volts.

8. The process of claim 6, wherein said first level is about 15 volts.

9. The process of claim 1, wherein the aqueous electrolytic solution contains sulfuric acid.

10. The process of claim 9, wherein said first level is about 10 volts.

* * * * *

UNITED STATES PATENT AND TRADEMARK OFFICE

CERTIFICATE OF CORRECTION

PATENT NO. : 5 160 599

DATED : November 3, 1992

INVENTOR(S) : Kenzo KOBAYASHI et al

It is certified that error appears in the above-identified patent and that said Letters Patent is hereby corrected as shown below:

On the title page, item [57] in the ABSTRACT, line 2; after "alloys" insert ---,---.

line 3; change "or its alloy" to --or its alloys,--. its alloys---.

line 5; after "current" insert ---;---.

Column 7, line 14; change "then" to ---than---.

Column 8, line 6; after "wherein" insert ---said---.

Signed and Sealed this

Fifteenth Day of February, 1994

*Attest:*

Bruce Lehman

BRUCE LEHMAN

*Attesting Officer*

*Commissioner of Patents and Trademarks*